US005553837A

United States Patent [19]

Kahle

[11] Patent Number: 5,553,837

[45] Date of Patent: Sep. 10, 1996

[54] VACUUM WORKPIECE HOLDING DEVICE FOR A WORK TABLE

[76] Inventor: David A. Kahle, P.O. Box 227HC1, Leeper, Pa. 16233

[21] Appl. No.: 373,570

[22] Filed: Jan. 17, 1995

[51] Int. Cl.[6] ..... B25B 11/00

[52] U.S. Cl. ..... 269/21; 269/95; 269/296

[58] Field of Search ..... 269/21, 20, 296, 269/95; 451/388; 294/64.1; 279/3

[56] References Cited

U.S. PATENT DOCUMENTS

| | | | |
|---|---|---|---|
| 3,033,298 | 5/1962 | Johnson | 451/388 |
| 3,475,097 | 10/1969 | Bishop et al. . | |
| 3,484,093 | 12/1969 | Mermelstein . | |
| 3,520,055 | 7/1970 | Jannett . | |
| 4,088,312 | 5/1978 | Frosch et al. | 269/21 |
| 4,403,567 | 9/1983 | daCosta et al. . | |
| 4,491,306 | 1/1985 | Eickhorst | 269/21 |
| 4,596,569 | 7/1986 | Itamoto et al. . | |
| 4,795,518 | 1/1989 | Meinel et al. | 269/21 |
| 4,805,887 | 2/1989 | Ray | 269/21 |
| 5,120,033 | 6/1992 | Shoda | 269/21 |
| 5,364,083 | 11/1994 | Ross et al. | 269/21 |
| 5,433,657 | 7/1995 | Bovone | 269/21 |

*Primary Examiner*—Robert C. Watson
*Attorney, Agent, or Firm*—Cort Flint

[57] ABSTRACT

A vacuum cell device for holding work pieces on a work table, and a system comprising a plurality of the vacuum cells as needed to hold a particular workpiece, is disclosed wherein the individual vacuum cells comprises a pair of vacuum units connected together by an adjustment mechanism which allows the axial spacing of the vacuum units to be adjusted to fix the cell in a desired cell height. A first vacuum unit includes a workpiece interface surrounding an open top vacuum chamber, and the second vacuum unit comprises a work surface interface surrounding an open top vacuum chamber. A sealing element is carried about the periphery of each interface to seal against the workpiece and work surface. A separate vacuum source is provided to each vacuum chamber so that vacuum to the second vacuum unit may be maintained to hold the vacuum cell in its position on the work surface while vacuum is terminated to the first vacuum unit for exchange of workpieces and processing of repetitive workpieces on the same cell pattern.

24 Claims, 2 Drawing Sheets

Fig. 1.
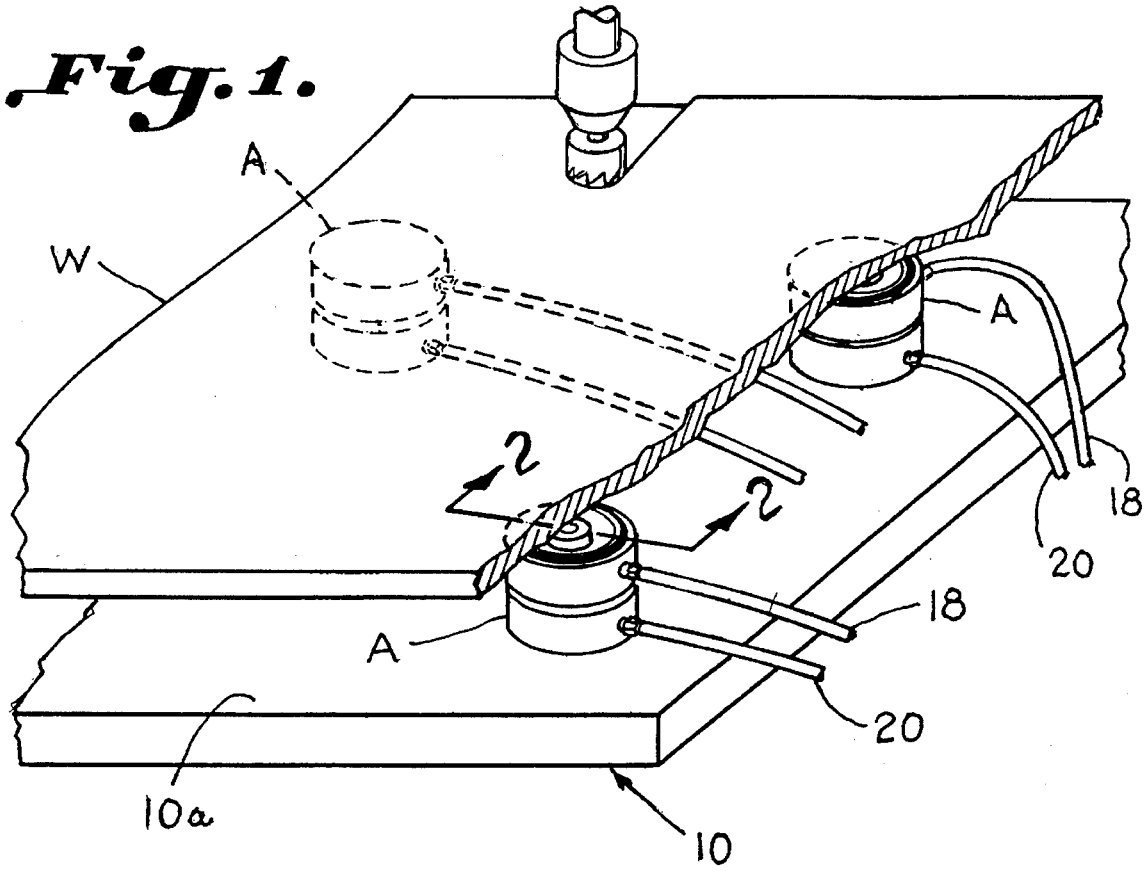
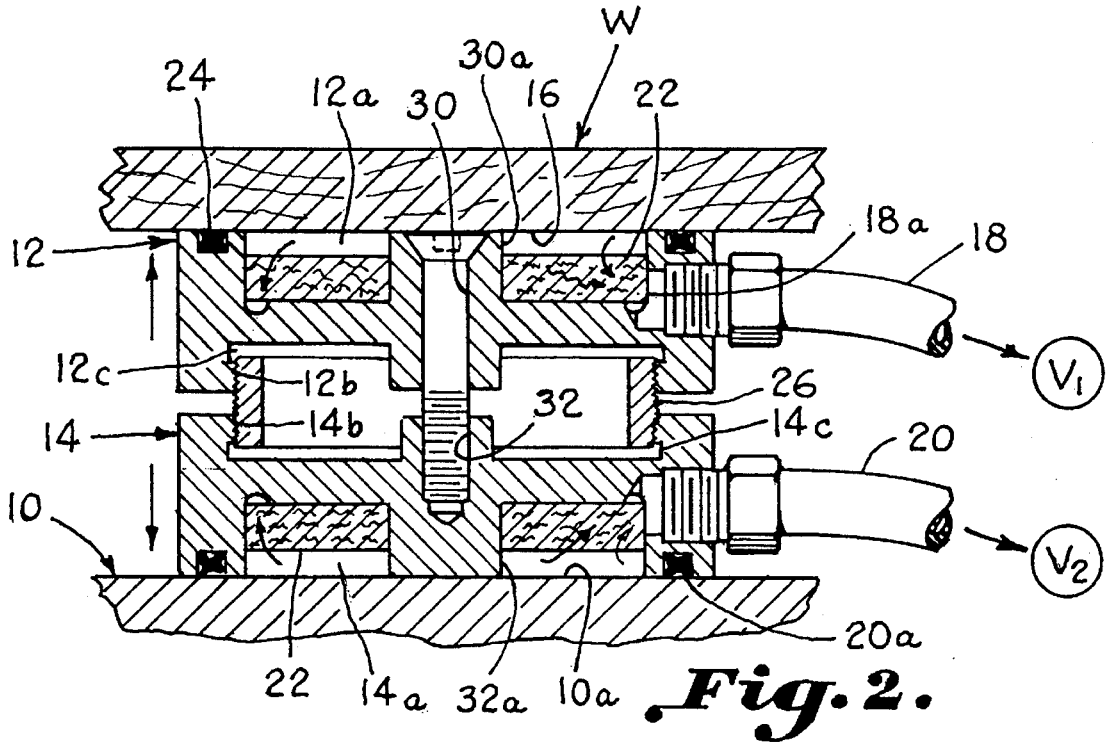
Fig. 2.

VACUUM WORKPIECE HOLDING DEVICE FOR A WORK TABLE

BACKGROUND OF THE INVENTION

This invention relates to a device for holding a workpiece firmly on a work table by means of a vacuum, and more particularly to a vacuum cell device which may be adjusted in its horizontal position on the table as well as its vertical position above the table for holding a wide variety of workpiece shapes and sizes on the same work surface.

Heretofore, vacuum hold down devices have been provided for holding various materials in many different types of industrial machinery operations without the use of clamps. One particular type of vacuum hold down system includes the use of a "spoil board" which is made in the image of the part to be machined or produced. The spoil board is lined with a gasket material so that vacuum can be applied to the central part of the board to hold the blank workpiece for machining. However, this system requires a different "spoil board" for every size and shape of workpiece that is to be machined. The resulting set up times to change from one workpiece to the next makes the system relatively inefficient.

Another system commonly used in the trade is referred to as the vacuum-pod system. The vacuum-pod system requires a large board which has been drilled and fitted with hundreds of vacuum-pods arranged so that in any situation the required vacuum-pods can be activated by inverting the pod to cause vacuum to flow through the pod and hold the workpiece or part in that particular location. This system requires the purchase of hundreds of vacuum-pods, the provision of a large number of vacuum-pod locations, and does not provide for vertical adjustment of the vacuum-pods or workpieces. In many manufacturing or machining operations, the workpieces have uneven surfaces. Because of this, and other reasons, it is highly desirable to be able to adjust the vertical height of the device or unit which is holding the workpiece so that the top surface which is being machined or worked on may be presented in a planar position. Further, the work table surface on which the workpieces are supported are not always perfectly level and require vertical adjustment for the planer positioning of a workpiece. To be able to accommodate different sizes and shapes of workpieces, it is desirable to be able to vary the number of devices utilized to support the workpieces without undue difficulty and expense.

Various individual workpiece holders have been provided for holding different types of workpieces and small parts. In particular, small part holders have been utilized in the semi-conductor field to hold small circuit and other electronic elements for processing such as shown in U.S. Patent Nos. 3,520,055; 4,403,567; 4,596,569; and 3,475,097. These devices are usually suitable only for miniature parts. For this purpose, the workpiece holders typically include small orifices through which a vacuum is drawn for holding the miniature workpiece. U.S. Pat. No. 3,484,093 discloses an article holding apparatus wherein a miniature workpiece is supported on resilient rings projecting above a surface through which a vacuum admission hole communicates. None of the small part, workpiece holders are suitable for holding large workpieces which are processed in industrial machining and manufacturing operations.

Accordingly, an object of the invention is to provide an improved workpiece holding device of the vacuum type for supporting a variety of workpiece sizes and shapes.

Accordingly, an object of the invention is to provide a workpiece holding device of the vacuum type which may be adjusted horizontally and vertically relative to a work surface in a quick and convenient manner.

Another object of the present invention is to provide a vacuum workpiece holding system comprising a plurality of individual workpiece which may be adjusted in their position relative to a work table surface in order to be optimally located for supporting a specific workpiece shape and size in a proper position.

Still another important object of the present invention is to provide a vacuum workpiece holding system comprising a plurality of individual vacuum cells which may be adjusted in their vertical position relative to a workpiece table to support a workpiece in a level, planar configuration.

SUMMARY OF THE INVENTION

The above objectives are accomplished according to the invention by providing a vacuum cell for holding a workpiece on a work surface. The vacuum cell is comprised of a first vacuum unit which has a vacuum chamber surrounded by a workpiece interface for engaging the workpiece, and a second vacuum unit which has a vacuum chamber surrounded by a work surface interface for engaging the work surface. The workpiece interface and the work surface interface face in opposing directions to hold workpiece and work surface, respectively, by vacuum. An adjustment mechanism interconnects the first and second vacuum units for adjusting the axial spacing between the first and second vacuum units to define a total cell height for the vacuum cell. Advantageously, the adjustment mechanism may include a threaded insert carried between the first and second vacuum units. The first vacuum unit comprises an opposite face which is opposite from the workpiece interface; and the second vacuum unit includes an opposite face which is opposite from the work surface interface. The threaded insert is threadably received within the opposite faces of the first and second vacuum units. A lock may be provided for locking the first and second vacuum units in a desired axial spacing to fix the cell height. The lock includes a bore which extends through the first vacuum unit, and a threaded bore is formed within the second vacuum unit. A locking screw extends through the first and threaded bores to secure the first and second vacuum units together in the desired axial spacing. Preferably, the workpiece interface and the work surface interface each include a sealing ring for sealing against the respective workpiece and work surface. The sealing rings comprise a quad ring having a pair of spaced edges which seal against the workpiece and work surface at spaced lines of contact around the periphery of the workpiece and work surface interface. The vacuum chambers of the first and second vacuum units include an annular vacuum chamber which is open for applying a suction against respective surfaces of the workpiece and work surface generally around the entire periphery of the workpiece and work surface interfaces. The quad ring has a pair of spaced edges which seals against the workpiece and work surface at spaced lines of contact around the periphery of the workpiece and work surface interface.

A system for supporting diverse workpieces having different sizes and shapes on a work surface is provided by disposing a plurality of the vacuum cells between the workpiece and the work surface. Each the vacuum cell comprises at least one vacuum unit having a vacuum chamber surrounded by a workpiece interface for engaging the workpiece and holding the workpiece by vacuum. A vertical adjustment mechanism mounts the vacuum unit to the work surface so that the vertical distance between the vacuum unit and the work surface may be adjusted to define a cell height for the vacuum cell. The cell height of the individual vacuum cells may be adjusted to place the workpiece in a desired position. In this manner, multiple workpieces may be removed and installed from the vacuum cells in a level configuration by selectively terminating vacuum to the first vacuum unit while maintaining vacuum at the second vacuum unit at all times to maintain the holding pattern of the cells for repetitive working of workpieces. The vertical adjustment mechanism includes a second vacuum unit which has a work surface interface for engaging and holding the workpiece against the work surface. A threaded insert is carried between the first and second vacuum units by which an axial spacing between the vacuum units may be adjusted.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 1 is a perspective view illustrating a vacuum workpiece holding system incorporating a plurality of individual workpiece holder devices according to the invention;

FIG. 2 is a sectional view taken along line 2—2 of FIG. 1;

DESCRIPTION OF A PREFERRED EMBODIMENT

Figure 3:
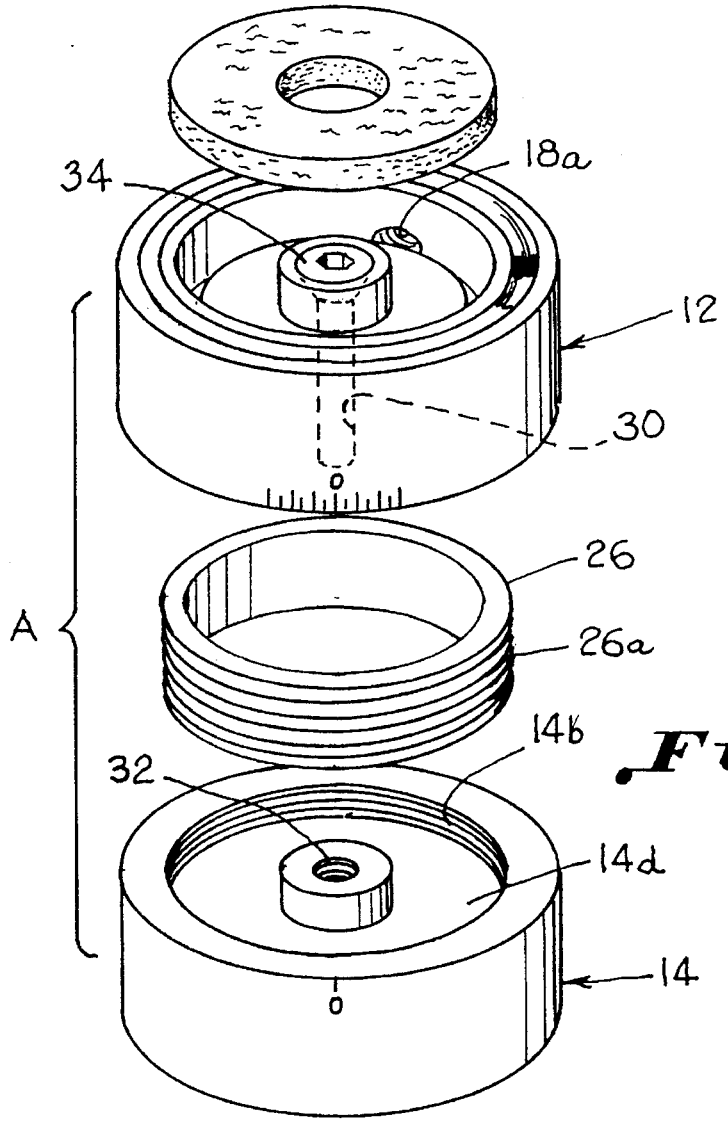
FIG. 3 is a perspective view with parts separated illustrating a vacuum operated workpiece holding device according to the invention.

Referring now in more detail to the drawings, a vacuum system for holding a workpiece is illustrated in FIG. 1 wherein a plurality of vacuum cells A support a workpiece W above a flat surface 10 which may be the top surface of any machine table, work bench, etc., such as a smooth, phenolic or metal surface. Each of the vacuum cells A is identical and the number provided depends on the size and shape of the workpiece to be held, and the application being made. As can best be seen in FIG. 2, each vacuum cell includes a first vacuum unit, designated generally as 12, and a second vacuum unit, designated generally as 14. In the illustrated embodiment, the first and second vacuum units are illustrated on a horizontal work surface and the workpiece W is likewise illustrated in a horizontal configuration in which the first and second vacuum units become top and bottom vacuum units, respectively. It is to be understood that the vacuum cells may be used in various other configurations besides horizontal so that the vacuum units assume orientations other than top and bottom. First vacuum unit 12 includes a first vacuum chamber 12*a* and second vacuum unit 14 includes a second vacuum chamber 14*a*. The vacuum is produced in chamber 12*a* to hold a corresponding surface of workpiece W and a vacuum is produced in vacuum chamber 14*a* to hold against upper surface 10*a* of work table 10. For this purpose, there is a vacuum line 18 connected to vacuum unit 12 which communicates a vacuum into vacuum chamber 12*a*, and a vacuum line 20 which communicates a vacuum to the interior of vacuum chamber 14*a*. Since in many industrial machining processes, metallic and wood shavings are created, it is preferred that a suitable filter 22 be included in each vacuum chamber of each unit 12, 14. Filter 22 may be any suitable filter such as a felt filter and the like to minimize the amount of shavings, dust, and other debris sucked into the vacuum system, connected to vacuum lines 18, 20.

Figure 5:
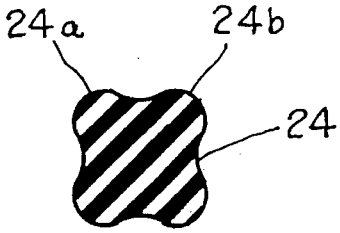
FIG. 5 is a sectional view of a quad ring in a vacuum cell according to the invention for positively holding a workpiece.
Figure 4:
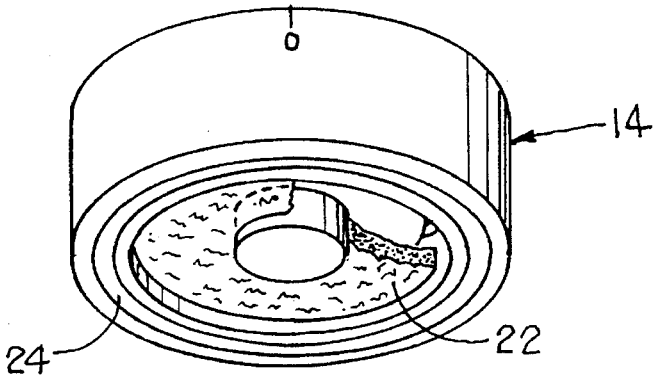
FIG. 4 is a bottom plan view of a workpiece holding device according to the invention with parts cut away.

As can best be seen in FIGS. 2 and 3, vacuum units 12, 14 are mirror images of each other and vacuum chambers 12*a*, 14*a* are separate and completely isolated from each other. A resilient quad ring 24 is carried within a circumferential groove formed around the vacuum chambers of each vacuum unit. The quad ring includes two spaced sealing edges 24*a*, 24*b* (FIG. 5) which support a bottom surface 16 of workpiece W at spaced points to ensure a tight seal and effective vacuum in the chamber for positively holding the workpiece regardless of surface irregularities and flatness variations. The quad rings may be provided in various durometers and sizes depending on the type of material to be held and the surface smoothness of the machine table, etc. This has been found to be an expedient, particularly where the bottom surface of the workpieces are uneven.

Quite advantageously, holding vacuum unit 12 is mounted to work surface 10 by a vertical adjustment mechanism so that the distance of the unit, and the workpiece, above the work surface may be varied. In the illustrated embodiment, the vertical adjustment mechanism which includes a threaded insert 26 which interconnects the two vacuum unit halves and lower unit 14 acts as the mount. The threaded insert is received within peripheral threads 12*b*, 14*b* formed around a bore 12*c*, 14*c* of each of the vacuum units (FIG. 2). Since the vacuum units are virtually mirror images of each other, the manufacture of the vacuum cell is greatly simplified. Threaded insert 26 is preferably turned to 25 threads per inch (TPI) which causes the halves to become vertically adjustable at 0.040 inches per revolution or 0.010 per quarter turn which provides accurate adjustment without need of measuring instruments for most applications. For this purpose, graduated indicia 33 may be inscribed around the circumference of the mating outside diameters of the vacuum units for incremental adjustment of .001 inches. A center drilled bore 30 is formed in a hub 30*a* of vacuum unit 12. An axially aligned, threaded bore 32 is formed in a similar hub 32*a* of second vacuum unit 14. A threaded bolt 34 extends through bore 30 and into threaded bore 32 for fastening the first and second vacuuming units together. To adjust the relative vertical positions of the vacuum units, threaded bolt 34 is loosened and the adjustment is made. Once the adjustment is made, the locking screw may be tightened to hold the adjustment throughout the set-up and application being made.

Thus, it can be seen that an advantageous construction for a vacuum system for holding various sizes and shapes of workpieces may be had according to the invention by utilizing one or more vacuum cells A having a unique construction which permits them to be positioned on top of a work surface as desired to optimally support and hold a workpiece regardless of the size and shape of the workpiece. The number of the vacuum cells provided may be varied depending on the number required to provide the necessary hold down force, and the part to be machined positioned on top of the cell unit.

Since the vacuum chambers of the two vacuum units are isolated, separate vacuum systems and manifolds V1 and V2 may be used to control the vacuum at the workpiece and support surface interfaces, making the set up secure, and making the workpiece change effortless. For example, in a manufacturing process of routing cabinet doors with a router 40, four vacuum cells A may be used to support the door workpiece, one cell at each corner of the door. The four cells by be adjusted in their vertical height to provide a desired depth of cut into the workpiece by the router, and to provide a level orientation of the door for a uniform cut into the door. Once a door is routed, the vacuum V1 to the upper vacuum units 12 is cut off while vacuum V2 to lower units 14 is maintained. In this manner, the finished door may be removed and an unfinished door place in the same position on the cells for processing of another door. The cells are held in place on the work surface by the vacuum V2 on the lower vacuum units. If desired, a grid may be provided on the work surface so that the location of the cells on the work surface may be programmed into the computerized system which controls the router for the particular application being made.

Since the vacuum cells can be located as desired on the machine table, fewer are required to be purchased initially, and they can be added as necessary later. Naturally, the size of the cells may be varied for smaller or larger workpieces or parts, as well as modifications which can be made to the threaded insert to create various adjustments between the first and second vacuum units such as a protractor adjustment making possible fixturing at various angles to the plane of a machine table.

While a preferred embodiment of the invention has been described using specific terms, such description is for illustrative purposes only, and it is to be understood that changes and variations may be made without departing from the spirit or scope of the following claims.

What is claimed is:

1. A vacuum cell for holding a workpiece on a work surface comprising:

a first vacuum unit having vacuum chamber surrounded by a workpiece interface for engaging said workpiece;

a second vacuum unit having vacuum chamber surrounded by a work surface interface for engaging said work surface;

said workpiece interface and said work surface interface facing in opposing directions for holding said workpiece and work surface, respectively, by vacuum; and a manually operable adjustment mechanism interconnecting said first and second vacuum units for positively moving said first vacuum chamber relative to said second vacuum chamber to adjust the axial spacing between said first and second vacuum units to define a total cell height for said vacuum cell.

2. The device of claim 1 wherein said adjustment mechanism includes a threaded insert carried between said first and second vacuum unit.

3. The device of claim 2 including a lock for locking said first and second vacuum units in a desired axial spacing so that said cell height is set.

4. The device of claim 2 wherein said first vacuum unit comprises an opposite face which is opposite from said workpiece interface, said second vacuum unit includes an opposite face which is opposite from said work surface interface, and said threaded insert is threadably received within said opposite faces of said first and second vacuum units.

5. The device of claim 4 including a lock for locking said first and second vacuum units in a desired axial spacing to fix said cell height.

6. The device of claim 5 wherein said lock includes a bore extending through said first vacuum unit, a threaded bore formed within said second vacuum unit, and a locking screw extending through said first and threaded bores to secure said first and second vacuum units together in said desired axial spacing.

7. The device of claim 1 wherein said workpiece interface and said work surface interface each include a sealing ring for sealing against said respective workpiece and work surface.

8. The device of claim 7 wherein said sealing rings comprise a quad ring having a pair of spaced edges which seal against said workpiece and work surface at spaced lines of contact around the periphery of said workpiece and work surface interface.

9. The device of claim 1 wherein said vacuum chambers of said first and second vacuum units include an annular vacuum chamber which is open for applying a suction against respective surfaces of said workpiece and work surface generally around the entire periphery of said workpiece and work surface interfaces.

10. The device of claim 9 comprising a quad ring having a pair of spaced edges which seals against said workpiece and work surface at spaced lines of contact around the periphery of said workpiece and work surface interface.

11. The device of claim 1 including a lock for maintaining said first and second vacuum units in a desired axial spacing to fix said cell height.

12. The device of claim 1 including a filter element disposed in said vacuum chambers to prevent the removal of debris through said vacuum system.

13. A vacuum cell for holding a workpiece on a work surface comprising:

a first vacuum unit having a vacuum chamber surrounded by a workpiece interface which includes a rigid peripheral rim for engaging said workpiece;

a second vacuum unit having a vacuum chamber surrounded by a work surface interface which includes a rigid peripheral rim for engaging said work surface;

said workpiece interface and said work surface interface facing in opposing directions for holding said workpiece and work surface, respectively, by vacuum;

said vacuum chambers of said first and second vacuum units include an open top vacuum chamber surrounded by said workpiece and work surface interfaces for applying a suction against respective surfaces of said workpiece and work surface generally around the entire periphery of said workpiece and work surface interfaces; and a resilient sealing element carried adjacent said rigid peripheral rims of said workpiece and work surface interfaces which seals against said workpiece and work surface around the periphery of said workpiece and work surface interface.

14. The device of claim 13 including an adjustment mechanism interconnecting said first and second vacuum units for adjusting the axial spacing between said first and second vacuum units to define a total cell height for said vacuum cell.

15. The device of claim 14 wherein said adjustment mechanism includes a threaded insert carried between said first and second vacuum unit.

16. The device of claim 15 including a lock for locking said first and second vacuum units in the desired axial spacing so that said cell height is set.

17. The device of claim 13 wherein said workpiece and work surface interfaces are annular, and sealing elements comprise quad rings each having a pair of spaced edges which seal against said workpiece and work surface at spaced lines of contact around the periphery of said workpiece and work surface interface.

18. A system for supporting diverse workpieces having different sizes and shapes on a work surface comprising:

a plurality of freely spaceable vacuum cells disposed between said workpiece and said work surface;

each said vacuum cell comprising a first vacuum unit having a vacuum chamber surrounded by a workpiece interface for engaging said workpiece and holding said workpiece by vacuum;

a second vacuum unit having a vacuum chamber surrounded by a work surface interface for engaging and holding against said work surface;

a threaded vertical adjustment mechanism mounting said vacuum unit to said work surface so that the vertical distance between said vacuum unit and said work surface may be adjusted to define a cell height for said vacuum cell;

whereby said cell height of said individual vacuum cells may be adjusted to uniformly engage said workpiece and place said workpiece in a desired position.

19. The device of claim 18 wherein said vertical adjustment mechanism includes a threaded insert carried between said first and second vacuum units by which an axial spacing between said vacuum units may be adjusted.

20. The device of claim 19 wherein said first vacuum unit comprises an opposite face which is opposite from said workpiece interface, said second vacuum unit includes an opposite face which is opposite from said work surface interface, and said threaded insert is threadably received within said opposite faces of said first and second vacuum units.

21. The device of claim 20 including a lock for locking said first and second vacuum units in a desired axial spacing to fix said cell height.

22. The device of claim 21 wherein said lock includes a bore extending through said first vacuum unit, a threaded bore formed within said second vacuum unit, and a locking screw extending through said first and threaded bores to secure said first and second vacuum units together in said desired axial spacing.

23. The device of claim 18 wherein said workpiece interface and said work surface interface each include a sealing ring for sealing against said respective workpiece and work surface.

24. The device of claim 23 wherein said sealing rings comprise a quad ring having a pair of spaced edges which seal against said workpiece and work surface at spaced lines of contact around the periphery of said workpiece and work surface interface.

* * * * *